US007860260B2

(12) United States Patent
Kim et al.

(10) Patent No.: US 7,860,260 B2
(45) Date of Patent: Dec. 28, 2010

(54) METHOD, APPARATUS, AND COMPUTER READABLE MEDIUM TO REPRODUCE A 2-CHANNEL VIRTUAL SOUND BASED ON A LISTENER POSITION

(75) Inventors: Sun-min Kim, Suwon-si (KR); Joon-hyun Lee, Seongnam-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 1620 days.

(21) Appl. No.: 11/132,298

(22) Filed: May 19, 2005

(65) Prior Publication Data

US 2006/0062410 A1 Mar. 23, 2006

(30) Foreign Application Priority Data

Sep. 21, 2004 (KR) ..... 10-2004-0075580

(51) Int. Cl.
*H04R 5/02* (2006.01)
*H04R 5/00* (2006.01)

(52) U.S. Cl. ..... 381/310; 381/17; 381/309

(58) Field of Classification Search ..... 381/1, 381/17–19, 309, 310
See application file for complete search history.

(56) References Cited

U.S. PATENT DOCUMENTS 5,910,990 A * 6/1999 Jang ..... 381/1
6,243,476 B1 * 6/2001 Gardner ..... 381/303
6,553,121 B1 * 4/2003 Matsuo et al. ..... 381/17
6,741,273 B1 5/2004 Waters et al.
6,947,569 B2 * 9/2005 Yamada et al. ..... 381/310
7,095,865 B2 * 8/2006 Katayama et al. ..... 381/309
7,113,610 B1 * 9/2006 Chrysanthakopoulos .... 381/309
7,369,667 B2 * 5/2008 Yamada ..... 381/309
7,480,386 B2 * 1/2009 Ogata ..... 381/310
2004/0032955 A1 * 2/2004 Hashimoto et al. ..... 381/18

FOREIGN PATENT DOCUMENTS

| | | |
|---|---|---|
| DE | 10125229 | 11/2002 |
| JP | 2000-295698 | 10/2000 |
| NL | 1014777 | 12/2000 |
| WO | WO 99/49574 | 10/1999 |
| WO | WO 02/41664 | 5/2002 |

OTHER PUBLICATIONS

Dutch Search Report dated Apr. 16, 2007 issued in Dutch Patent Application No. 1029844.

* cited by examiner

*Primary Examiner*—Xu Mei
(74) *Attorney, Agent, or Firm*—Stanzione & Kim LLP

(57) ABSTRACT

A method of reproducing a virtual sound and an apparatus to reproduce a 2-channel virtual sound from a 5.1 channel (or 7.1 channel or more) sound using a two-channel speaker system. The method includes: generating a 2-channel virtual sound from a multi-channel sound, sensing a listener position with respect to two speakers, generating a listener position compensation value by calculating output levels and time delays of the two speakers with respect to the sensed listener position, and compensating output values of the generated 2-channel virtual sound based on the listener position compensation value.

10 Claims, 4 Drawing Sheets

METHOD, APPARATUS, AND COMPUTER READABLE MEDIUM TO REPRODUCE A 2-CHANNEL VIRTUAL SOUND BASED ON A LISTENER POSITION

CROSS-REFERENCE TO RELATED APPLICATIONS

This application claims priority from Korean Patent Application No. 2004-75580, filed on Sep. 21, 2004, in the Korean Intellectual Property Office, the disclosure of which is incorporated herein in its entirety by reference.

BACKGROUND OF THE INVENTION

1. Field of the Invention

The present general inventive concept relates to a virtual sound reproducing system, and more particularly, to a method of reproducing a virtual sound and an apparatus to reproduce a 2-channel virtual sound from a 5.1 channel (or 7.1 channel or more) sound using a two-channel speaker system.

2. Description of the Related Art

A virtual sound reproducing system typically can provide the same surround sound effect detected in a 5.1 channel system using only two speakers.

A technology related to a conventional virtual sound reproducing system is disclosed in WO 99/49574 (PCT/AU99/00002, filed Jan. 6, 1999, entitled AUDIO SIGNAL PROCESSING METHOD AND APPARATUS). In the disclosed technology, a multi-channel audio signal is downmixed into a 2-channel audio signal using a head-related transfer function (HRTF).

FIG. 1 is a block diagram illustrating the conventional virtual sound reproducing system. Referring to FIG. 1, a 5.1 channel audio signal is input. The 5.1 channel audio signal includes a left-front channel 2, a right-front channel, a center-front channel, a left-surround channel, a right-surround channel, and a low-frequency (LFE) channel 13. Left and right impulse response functions are applied to each channel. Therefore, a left-front impulse response function 4 for a left ear is convolved with a left-front signal 3 with respect to the left-front channel 2 in a convolution operation 6. The left-front impulse response function 4 uses the HRTF as an impulse response to be received by the left ear in an ideal spike pattern output from a left-front channel speaker located at an ideal position. An output signal 7 of the convolution operation 6 is mixed into a left channel signal 10 for headphones. Similarly, in a convolution operation 8, a left-front impulse response function 5 for a right ear is convolved with the left-front signal 3 in order to generate an output signal 9 to be mixed to a right channel signal 11. Therefore, the arrangement of FIG. 1 requires 12 convolution operations for the 5.1 channel audio signal. Ultimately, if the signals included in the 5.1 channel audio signal are reproduced as 2-channel signals by combining measured HRTFs and downmixing, it is possible to obtain the same surround sound effect as when the signals in the 5.1 channel audio signal are reproduced as multi-channel signals.

However, a system for receiving a 5.1 channel (or 7.1 channel) sound input and reproducing virtual sound using a 2-channel speaker system has a disadvantage in that, since the HRTF is determined with respect to a predetermined listening position within the 2-channel speaker system, a stereoscopic sensation dramatically decreases if a listener is out of the predetermined listening position.

SUMMARY OF THE INVENTION

The present general inventive concept provides a method of reproducing a 2-channel virtual sound and an apparatus to generate an optimal stereo sound by measuring a listener position and compensating output levels and time delay values of two speakers when a listener is out of a predetermining listening position (i.e., a sweet-spot position).

Additional aspects of the present general inventive concept will be set forth in part in the description which follows and, in part, will be obvious from the description, or may be learned by practice of the general inventive concept.

The foregoing and/or other aspects of the present general inventive concept are achieved by providing a method of reproducing a virtual sound comprising generating a 2-channel virtual sound from a multi-channel sound, sensing a listener position with respect to two speakers, generating a listener position compensation value by calculating output levels and time delays of the two speakers based on the sensed listener position, and compensating output values of the generated 2-channel virtual sound based on the listener position compensation value.

The foregoing and/or other aspects of the present general inventive concept are also achieved by providing a virtual sound reproducing apparatus comprising a virtual sound signal processing unit to process a multi-channel sound stream into 2-channel virtual sound signals, and a listener position compensator to calculate a listener position compensation value based on a listener position and to compensate levels and time delays of the 2-channel virtual sound signals processed by the virtual sound signal processing unit. The listener position compensator may comprise a listener position sensor to measure an angle and a distance of the listener position with respect to a center position of two speakers, a listener position compensation value calculator to calculate output levels and time delays of the two speakers based on the angle and the distance between the listener position and the center position of the two speakers sensed by the listener position sensor, and a listener position compensation processing unit to compensate the 2-channel virtual sound signals based on the output levels and time delays of the two speakers calculated by the listener position compensation value calculator.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
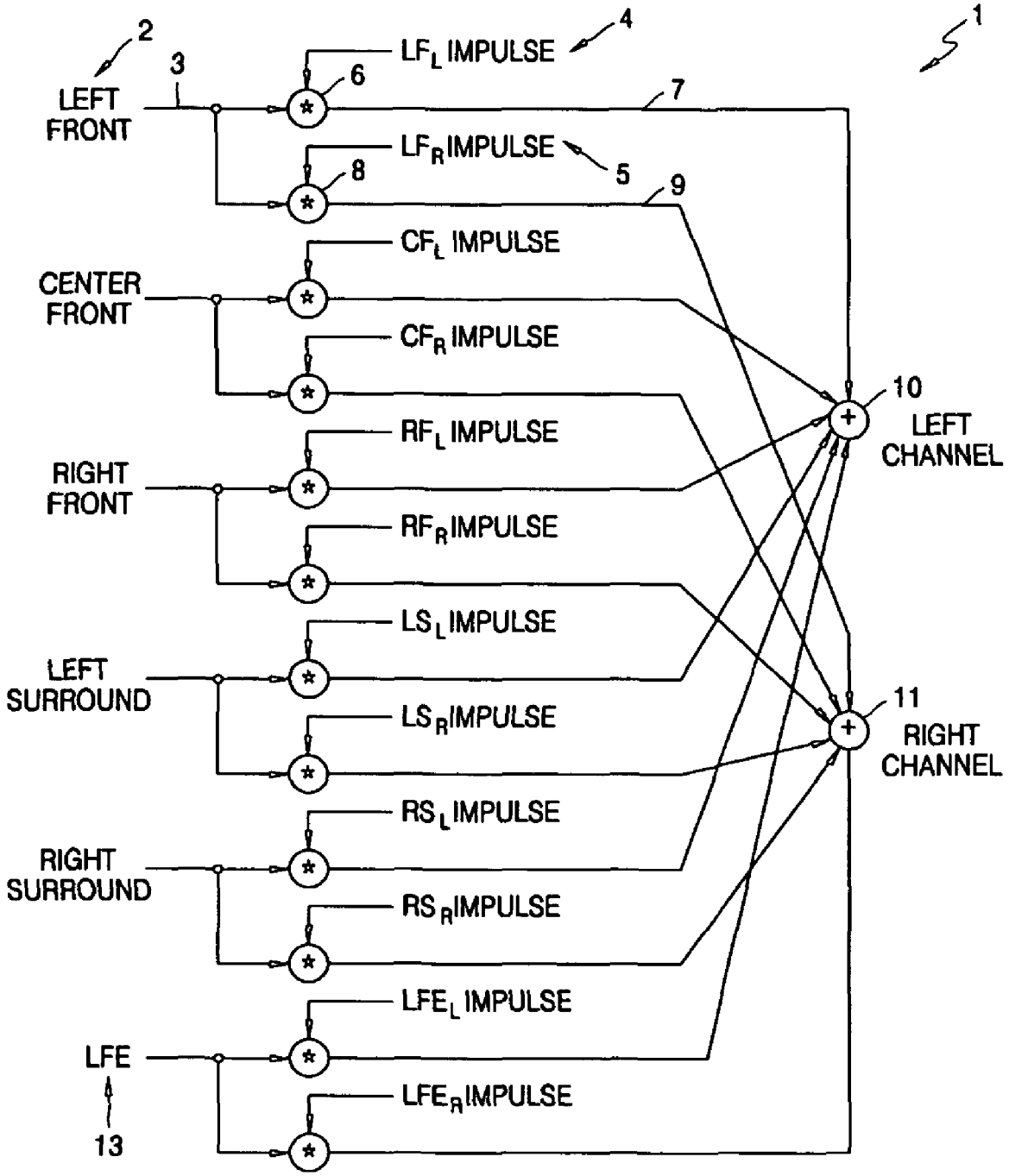
FIG. 1 (PRIOR ART)
FIG. 1 is a block diagram illustrating a conventional virtual sound reproducing system.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Figure 2:
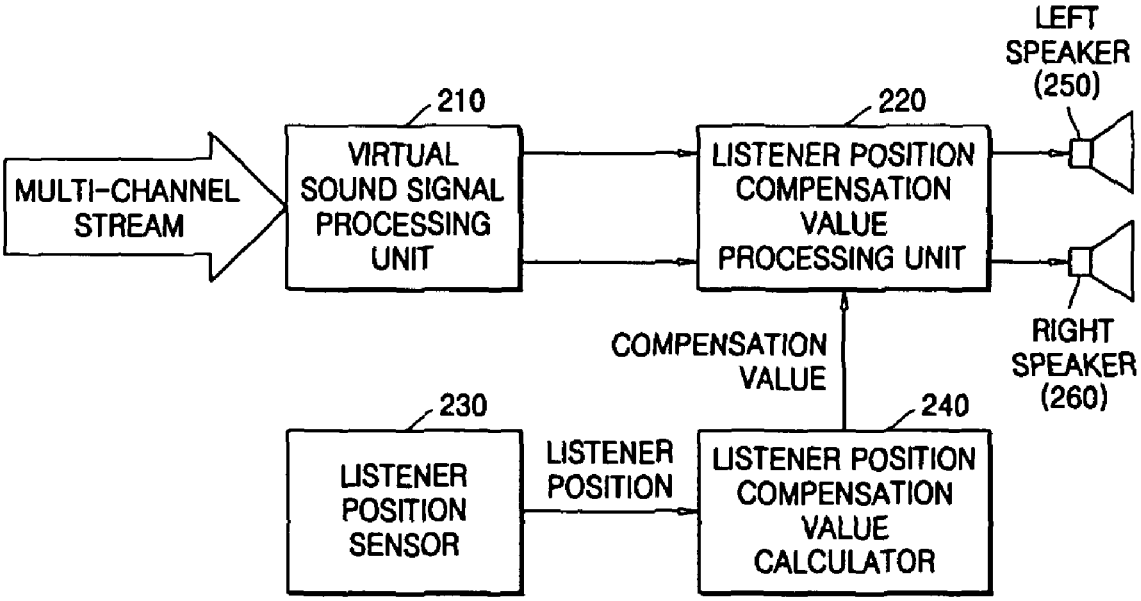
FIG. 2 is a block diagram illustrating a virtual sound reproducing apparatus according to an embodiment of the present general inventive concept.

FIG. 2 is a block diagram illustrating a virtual sound reproducing apparatus according to an embodiment of the present general inventive concept.

Referring to FIG. 2, the virtual sound reproducing apparatus includes a virtual sound signal processing unit 210, a listener position sensor 230, a listener position compensation value calculator 240, and a listener position compensation value processing unit 220.

The virtual sound signal processing unit 210 converts a 5.1 channel (or 7.1 channel, or more) multi-channel audio stream into 2-channel audio data which can provide a stereoscopic sensation to a listener.

The listener can detect a multi-channel stereophonic effect from sound reproduced by the virtual sound signal processing unit 210. However, when the listener moves out of a predetermined listening position (i.e., a sweet-spot), the listener may detect a deterioration in the stereoscopic sensation.

Therefore, according to embodiments of the present general inventive concept, when the listener moves out of the predetermined listening position, an optimal stereo sound can be generated by measuring a listener position and compensating output levels and time delay values output by the virtual sound signal processing unit 210 to two speakers 250 and 260 (i.e., a left speaker and a right speaker). That is, the listener position sensor 230 measures an angle and a distance of a listener position with respect to a center position of the two speakers 250 and 260.

The listener position compensation value calculator 240 calculates the output levels and time delay values of the two speakers 250 and 260 based on the angle and the distance between the listener position sensed by the listener position sensor 230 and the center position of the two speakers 250 and 260.

The listener position compensation value processing unit 220 compensates the 2-channel virtual sound signals processed by the virtual sound signal processing unit 210 by an optimal value suitable for the listener position using the output levels and time delay values of the two speakers 250 and 260 calculated by the listener position compensation value calculator 240. In other words, the listener position compensation value processing unit 220 adjusts the output levels and time delay values received from the virtual sound signal processing unit 210 according to input from the listener position compensation value calculator 240.

Finally, the 2-channel virtual sound signals output from the listener position compensation value processing unit 220 are output to the left and right speakers 250 and 260.

Figure 3:
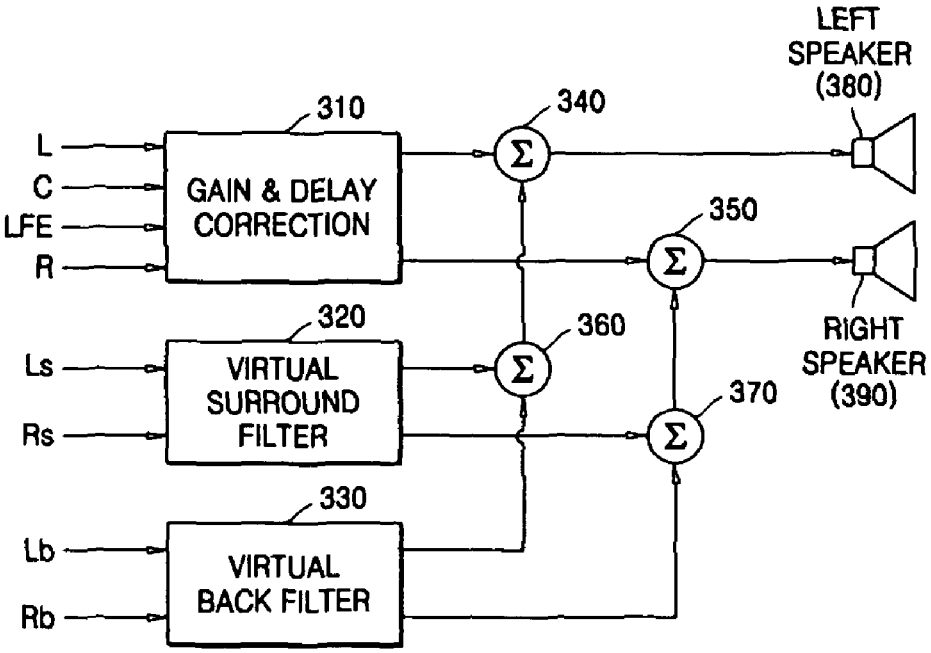
FIG. 3 is a detailed block diagram illustrating a virtual sound signal processing unit of the virtual sound reproducing apparatus of FIG. 2.

FIG. 3 is a detailed block diagram illustrating the virtual sound signal processing unit 210 of FIG. 2.

Referring to FIG. 3, a virtual surround filter 320 is designed using a head-related transfer function (HRTF) and generates sound images of left and right sides of a listener from left and right surround channel sound signals $L_s$ and $R_s$. A virtual back filter 330 generates sound images of left and right rear sides of the listener from left and right back channel sound signals $L_b$ and $R_b$. A sound image refers to a location where the listener perceives that a sound originates in a two or three dimensional sound field. A gain and delay correction filter 310 compensates gain and delay values of left, center, LFE, and right channel sound signals. The gain and delay correction filter 310 can compensate the left, center, LFE, and right channel sound signals for a change in gain and a delay induced in the left surround $L_s$, right surround $R_s$, right back $R_b$, and left back $L_b$ channel sound signals by the virtual surround filter 320 and the virtual back filter 330, respectively. The virtual surround filter 320 and the virtual back filter 330 each output a left virtual signal and a right virtual signal to be added to the sound signals output by the gain and delay correction filter 310 and output by left and right speakers 380 and 390, respectively. The left and right virtual sound signals output from the virtual surround filter 320 and virtual back filter 330 are added to each other by first and second adders 360 and 370, respectively. Further, the added left and right virtual sound signals output by the first and second adders 360 and 370 are then added to the sound signals output from the gain and delay correction filter 310 by third and fourth adders 340 and 350 and output to the left and right speakers 380 and 390, respectively.

FIG. 3 illustrates a virtual sound signal processing of 7.1 channels. When processing a 5.1 channel sound, since values of the left and right back channel sound signals $L_b$ and $R_b$ are 0 for the 5.1 channel sound, the virtual back filter 330 is not used and/or can be omitted.

Figure 4:
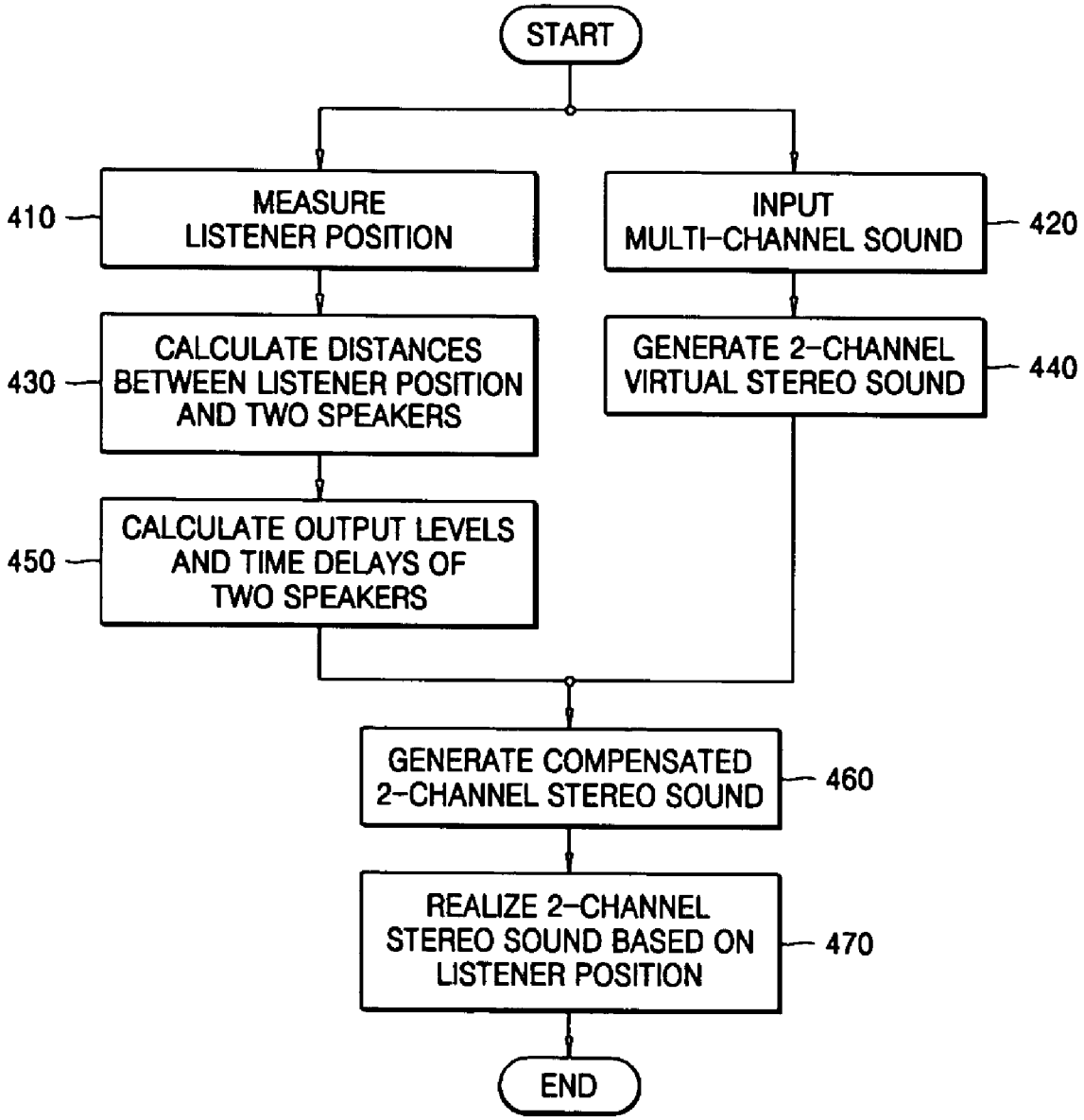
FIG. 4 is a flowchart illustrating a method of reproducing a virtual sound based on a listener position according to an embodiment of the present general inventive concept.

FIG. 4 is a flowchart illustrating a method of reproducing a virtual sound based on a listener position according to an embodiment of the present general inventive concept.

Referring to FIG. 4, 2-channel stereo sound signals are generated from multi-channel sound signals using a virtual sound processing algorithm in operations 420 and 440.

A listener position is measured in operation 410.

Figure 5:
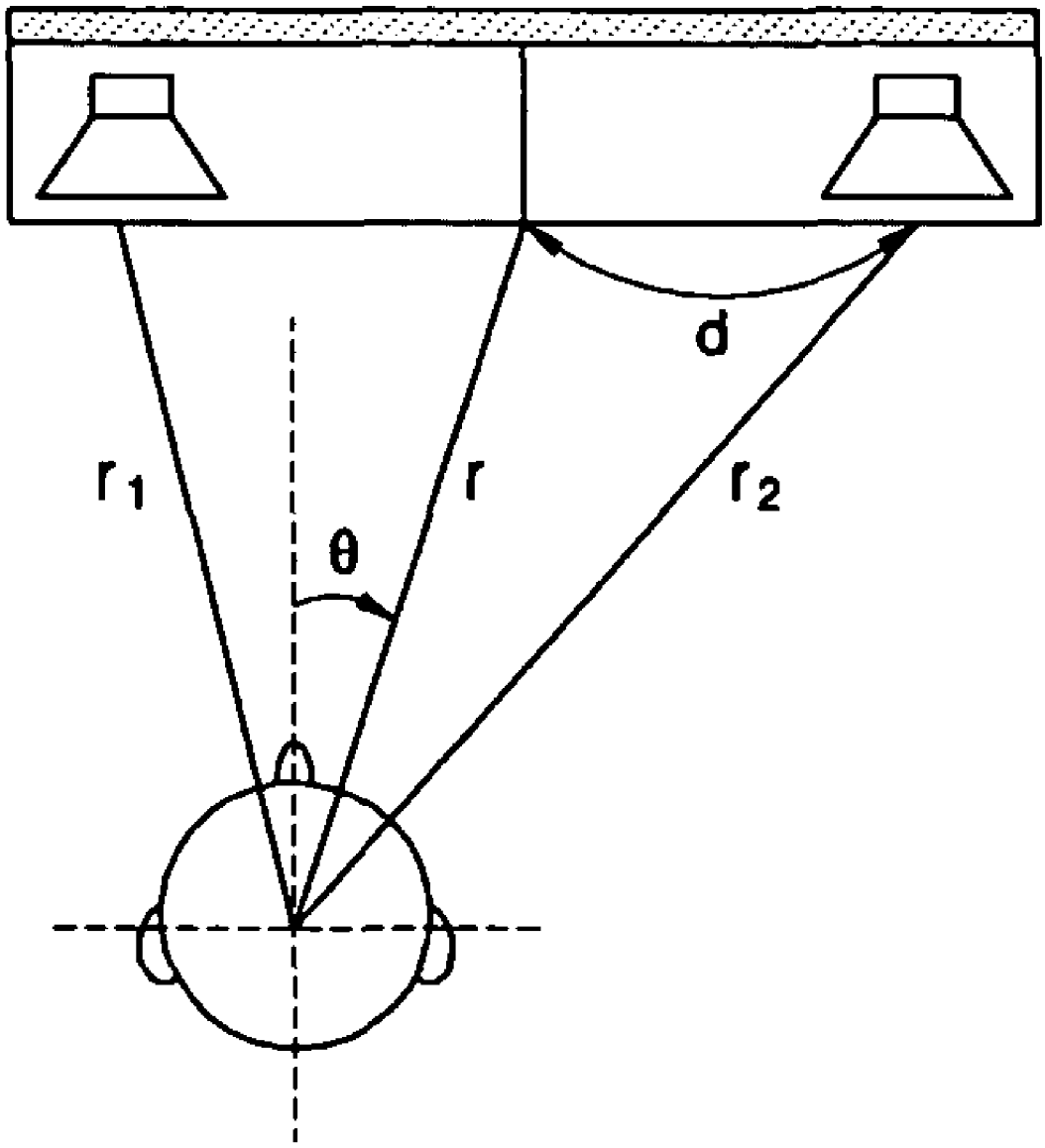
FIG. 5 is a diagram illustrating geometry of two speakers and a listener.

A distance r and an angle θ from the listener position with respect to a center position of two speakers are measured in operation 430. As illustrated in FIG. 5, the center position of the two speakers refers to a position that is half way between the two speakers. Thus, as illustrated in FIG. 5, if the center position of the two speakers is located to the right of the listener position, the angle θ is positive, and if the center position of the two speakers is located to the left of the listener position, the angle θ is negative. A variety of methods of measuring the listener position may be used with the embodiments of the present general inventive concept. For example, an iris detection method and/or a voice source localization method may be used. Since these methods are known and are not central to the embodiments of the present general inventive concept, detailed descriptions thereof will not be provided.

Output levels and time delay values of the two speakers corresponding to listener position compensation values are calculated based on the distance r and the angle θ between the sensed listener position and the center position of the two speakers in operation 450. Although some of the embodiments of the present general inventive concept determine a listener position with respect to the center position of the two speakers, the listening position may alternatively be determined with respect to other points in a speaker system. For example, the listener position may be determined with respect to one of the two speakers.

A distance $r_1$ between a left speaker and the listener position and a distance $r_2$ between a right speaker and the listener position are given by Equation 1:

$$r_1 = \sqrt{r^2 + d^2 - 2rd\sin\theta},\ r_2 = \sqrt{r^2 + d^2 + 2rd\sin\theta} \quad \text{[Equation 1]}$$

Here, r denotes the distance between the listener position and the center position of the two speakers. In a case where it may be difficult to obtain an actual distance, r may be assumed to be a predetermined value. For example, the predetermined value may be assumed to be 3m. d denotes a distance between the center position of the two speakers and one of the two speakers.

An output level gain g can be obtained for two cases based on a free field model and a reverberant field model. If a listening space approximates a free field (i.e., where a sound does not tend to echo), the output level gain g is given by Equation 2:

$$g = \frac{r_1}{r_2} \quad \text{[Equation 2]}$$

If the listening space does not approximate the free field (i.e., where sound tends to echo or reverberate), the output level gain g is given by Equation 3 using a total mean squared pressure formula of a direct and reverberant sound field:

$$g = \frac{r_1}{r_2}\sqrt{\frac{A + 16\pi r_2^2}{A + 16\pi r_1^2}} \quad \text{[Equation 3]}$$

Here, A denotes a total sound absorption (absorption area), and a value of A depends on characteristics of the listening space. Accordingly, in a case where it is difficult to determine the absorbency of the listening space, A may be obtained by making assumptions. For example, if it is assumed that the size of a room is $3\times8\times5$ $m^3$ and an average absorption coefficient is 0.3, A is assumed to be 47.4 $m^2$. Alternatively, the characteristics of the listening space may be predetermined experimentally. A time delay Δ generated by variation of the distances between the listener position and the two speakers is calculated using Equation 4:

$$\Delta = |\text{integer}(F_s(r_1 - r_2)/c)| \quad \text{[Equation 4]}$$

Here, $F_s$ denotes a sampling frequency, c denotes a velocity of sound, and integer denotes a function to round off to the nearest integer.

In operation 460, compensated 2-channel stereo sound signals are generated by adjusting the virtual 2-channel stereo sound signals to reflect the output levels and time delay values calculated in the operation 450.

In operation 470, a 2-channel stereo sound based on the listener position is realized. Thus, even if the listener moves out of the predetermined listening position (i.e., the sweet spot), the stereoscopic sensation produced by the virtual sound signal processing unit 210 (see FIG. 2) does not deteriorate. The listener position and the characteristics of the listening space are typically not reflected in the HRTF used for virtual sound signal processing. However, the embodiments of the present general inventive concept use a listener position compensation value that reflects the listener position and the characteristics of the listening space to reproduce a stereo sound that is optimized for a particular listener position. Since it is difficult to accurately model a real listening space in real time, approximate values can be calculated using procedures described above.

Therefore, output values processed using the virtual sound processing algorithm are compensated to be suitable for the listener position using the listener position compensation value. In the present embodiment, when the measured angle θ between the listener position and the center position of the two speakers is positive, only a left channel value $X_L$ out of the output values may be compensated, and a right channel value $X_R$ may not be compensated, as described in Equation 5:

$$y_L(n) = gx_L(n-\Delta),\ y_R(n) = x_R(n) \quad \text{[Equation 5]}$$

When the measured angle θ is negative, only the right channel value $X_R$ of the output values may be compensated, and the left channel value $X_L$ may not be compensated, as described in Equation 6:

$$y_L(n) = x_L(n),\ y_R(n) = \frac{1}{g}x_R(n-\Delta) \quad \text{[Equation 6]}$$

Therefore, if a right channel output value $Y_R$ and a left channel output value $Y_L$ are reproduced by the two speakers, an optimized stereo sound that is suitable for the listener position is generated.

The method of FIG. 4 may be repeatedly executed to compensate a virtual sound for repeated changes in the listener position. In other words, the listener position may be continuously measured in the operation 410 to determine whether a change in the listener position has occurred. Likewise, the virtual stereo sound may be continuously generated from the input multi-channel sound in the operations 420 and 440. Thus, when a change in the listener position is measured in the operation 410, the virtual stereo sound generated at the operation 440 can be compensated by performing the operations 430, 450, 460, and 470.

Additionally, although various embodiments of the present general inventive concept refer to a "listener position," it should be understood that the virtual sound may alternatively be received at a sound receiving position where sound may be received and detected. For example, the virtual sound may be detected, recorded, tested, etc. by a device at the sound receiving position.

Embodiments of the present general inventive concept can be written as computer programs, stored on computer-readable recording media, and read and executed by computers. Examples of such computer-readable recording media include magnetic storage media, e.g., ROM, floppy disks, hard disks, etc., optical recording media, e.g., CD-ROMs, DVDs, etc., and storage media such as carrier waves, e.g., transmission over the Internet. The computer-readable recording media can also be distributed over a network of coupled computer systems so that the computer-readable code is stored and executed in a decentralized fashion.

As described above, according to the embodiments of the present general inventive concept, even if a listener listens to 5.1 channel (or 7.1 channel or more) sound using 2-channel speakers, the listener can detect the same stereoscopic sensation as when listening to a multi-channel speaker system. Therefore, the listener can enjoy DVDs encoded into 5.1 channels (or 7.1 channels or more) using only a conventional 2-channel speaker system without buying additional speakers. Additionally, in a conventional virtual sound system, the stereoscopic sensation dramatically decreases when the listener moves out of a specific listening position within the 2-channel speaker system. However, by using the methods, systems, apparatuses, and computer readable recording media of the present general inventive concept, the listener can detect an optimal stereoscopic sensation regardless of whether the listener's position changes.

Although various embodiments of the present general inventive concept have been shown and described, it should be appreciated by those skilled in the art that changes may be made in these embodiments without departing from the principles and spirit of the general inventive concept, the scope of which is defined in the appended claims and their equivalents.

What is claimed is:

1. A method of reproducing a virtual sound in an audio output system, the method comprising:

generating a 2-channel virtual sound in the audio output system from a multi-channel sound;

sensing a listener position with respect to two speakers;

generating in the audio output system a listener position compensation value by obtaining output levels and time delays of the two speakers based on the sensed listener position and a characteristic of the listening space; and compensating output values of the generated 2-channel virtual sound based on the generated listener position compensation value, wherein the compensating of the output values of the generated 2-channel virtual sound comprises adjusting levels and time delays of the generated virtual sound to be suitable for the listener position based on the generated listener position compensation value, and when a measured angle θ is positive, a left channel level value $X_L$ of the virtual sound is compensated by $y_L(n)=gx_L(n-\Delta)$, $y_R(n)=x_R(n)$ and a right channel level value $X_R$ is output as is, and when the measured angle θ is negative, the right channel level value $X_R$ of the virtual sound is compensated by $$y_L(n) = x_L(n),\ y_R(n) = \frac{1}{g}x_R(n-\Delta)$$

and the left channel level value $X_L$ is output as is, where θ is an angle defined by a line extending from a center of a listener perpendicular to a line between two speakers and a line extending from the center of the listener to a center point between the two speakers, $y_L(n)$ is an adjusted left channel output value, $y_R(n)$ is an adjusted right channel output value, g is an output gain level, Δ denotes a time delay, and n denotes a compensation value.

2. The method of claim 1, wherein the sensing of the listener position comprises measuring an angle and a distance of the listener position with respect to a center position of the two speakers.

3. The method of claim 2, wherein the angle is positive when the center position of the two speakers is located to the right of the listener position, and the angle is negative when the center position of the two speakers is located to the left of the listener position.

4. The method of claim 1, wherein the generating of the listener position compensation value comprises obtaining the output levels and time delays of the two speakers based on the distance and the angle between the listener position and the center position of the two speakers.

5. The method of claim 4, wherein the output levels and time delays of the two speakers are obtained by one of the following:

$$g = \frac{r_1}{r_2}$$

$$g = \frac{r_1}{r_2}\sqrt{\frac{A+16\pi r_2^2}{A+16\pi r_1^2}}$$

$$\Delta=|\text{integer}(F_s(r_1-r_2)/c)|$$

where $r_1=\sqrt{r^2+d^2-2rd\sin\theta}$, $r_2=\sqrt{r^2+d^2+2rd\sin\theta}$, g denotes an output gain level, A denotes a total sound absorption in a listening space, Δ denotes a time delay, $F_s$ denotes a sampling frequency, c denotes a velocity of sound, "integer" denotes a function to round off to the nearest integer, r denotes a distance between the listener position and the center position of the two speakers, θ denotes an angle between the listener position and the center position of the two speakers, and d denotes a half of a distance between the two speakers.

6. The method of claim 1, wherein:

the generating the 2-channel virtual sound from the multichannel sound comprises continuously generating the 2-channel virtual sound;

the sensing of the listener position with respect to the two speakers comprises continuously sensing the listener position with respect to the two speakers; and the generating the of listener position compensation value comprises calculating the output levels and time delays of the two speakers based on the sensed listener position whenever a change in the listener position is sensed.

7. A method of reproducing a virtual sound while maintaining a stereoscopic sound regardless of position where the sound is being received, the method comprising:

generating virtual sound signals to reproduce at least three channel signals in a two-speaker system according to one or more head related transfer functions determined at a sweet spot of the two-speaker system; and applying to the generated sound signals a position-specific compensation factor to account for a distance between the sweet spot of the two speaker system and a position of where the sound is being received, wherein applying to the generated sound signals a position-specific compensation factor includes adjusting levels and time delays of the generated virtual sound to be suitable for the listener position based on the position-specific compensation factor, and when a measured angle θ is positive, a left channel level value $X_L$ of the virtual sound is compensated by $y_L(n)=gx_L(n-\Delta)$, $y_R(n)=x_R(n)$ and a right channel level value $X_R$ is output as is, and when the measured angle θ is negative, the right channel level value $X_R$ of the virtual sound is compensated by $y_L(n)=x_L(n)$, $y_R(n)=1/gx_R(n-\Delta)$ and the left channel level value $X_L$ is output as is, where θ is an angle defined by a line extending from a center of a listener perpendicular to a line between the two speakers and a line extending from a center of a listener to a center point between two speakers, $y_L(n)$ is an adjusted left channel output value, $y_R(n)$ is an adjusted right channel output value, g is an output gain level, Δ denotes a time delay, and n denotes a compensation value.

8. A virtual sound reproducing apparatus, comprising:

a virtual sound signal processing unit to process a multichannel sound stream into 2-channel virtual sound signals; and a listener position compensator to calculate a listener position compensation value based on a listener position and to compensate output levels and time delays of the 2-channel virtual sound signals processed by the virtual sound signal processing unit based on the calculated listener position compensation value, wherein the listener position compensator calculates the listener position compensation value such that, when a measured angle θ is positive, a left channel level value $X_L$ of the virtual sound is compensated by $y_L(n)=gx_L(n-\Delta)$, $y_R(n)=x_R(n)$ and a right channel level value $X_R$ is output as is, and when the measured angle θ is negative, the right channel level value $X_R$ of the virtual sound is compensated by $y_L(n)=x_L(n)$, $y_R(n)=1/gx_R(n-\Delta)$ and the left channel level value $X_L$ is output as is, where θ is an angle defined by a line extending from a center of a listener perpendicular to a line between two speakers and a line extending from the center of the listener to a center point between the two speakers, $y_L(n)$ is an adjusted left channel output value, $y_R(n)$ an adjusted right channel output value, g is an output gain level, Δ denotes a time delay, and n denotes a compensation value.

9. The apparatus of claim 8, wherein the listener position compensator comprises:

a listener position sensor to measure an angle and a distance of the listening position with respect to a center position of two speakers;

a listener position compensation value calculator to calculate output levels and time delays of the two speakers based on the distance and the angle between the listener position and the center position of the two speakers sensed by the listener position sensor; and a listener position compensation processing unit to compensate the 2-channel virtual sound signals based on the output levels and time delays of the two speakers calculated by the listener position compensation value calculator.

10. A computer readable medium having executable code to reproduce a virtual sound, the medium comprising:

a first code to generate a 2-channel virtual sound in an audio output system from a multi-channel sound;

a second code to sense a listener position with respect to two speakers of the audio output system;

a third code to generate a listener position compensation value by calculating output levels and time delays of the two speakers based on the sensed listener position; and a fourth code to compensate output values of the generated 2-channel virtual sound based on the generated listener position compensation value, wherein the compensating of the output values of the generated 2-channel virtual sound comprises adjusting levels and time delays of the generated virtual sound to be suitable for the listener position based on the generated listener position compensation value, when a measured angle θ is positive, a left channel level value $X_L$ of the virtual sound is compensated by $y_L(n)=gx_L(n-\Delta)$, $y_R(n)=x_R(n)$, and a right channel level value $X_R$ is output as is, and when the measured angle θ is negative, the right channel level value $X_R$ of the virtual sound is compensated by $y_L(n)=x_L(n)$, $y_R(n)=1/gx_R(n-\Delta)$ and the left channel level value $X_L$ is output as is, where θ is an angle defined by a line extending from a center of a listener perpendicular to a line between two speakers and a line extending from the center of the listener to a center point between the two speakers, $y_L(n)$ is an adjusted left channel output value, $y_R(n)$ is an adjusted right channel output value, g is an output gain level, Δ denotes a time delay, and n denotes a compensation value.

* * * * *